US005155881A

United States Patent [19]

Lafferty

[11] Patent Number: 5,155,881

[45] Date of Patent: Oct. 20, 1992

[54] ADJUSTABLE BED WITH WIRE GRID MATTRESS SUPPORT

[75] Inventor: G. Scott Lafferty, Wausau, Wis.

[73] Assignee: Batts, Inc., Zeeland, Mich.

[21] Appl. No.: 809,879

[22] Filed: Dec. 17, 1991

[51] Int. Cl.[5] ..... A47C 19/00

[52] U.S. Cl. ..... 5/186.1; 5/189; 5/617

[58] Field of Search ..... 5/186.1, 189, 191, 247, 5/613, 617, 618

[56] References Cited

U.S. PATENT DOCUMENTS

| | | | |
|---|---|---|---|
| 264,711 | 9/1882 | Mothe | 5/617 |
| 1,369,173 | 2/1921 | Heyser | 5/617 |
| 1,400,734 | 12/1921 | Drefs . | |
| 1,961,144 | 6/1934 | Griffith | 5/186.1 |
| 2,062,056 | 11/1936 | Herod | 5/617 |
| 2,747,919 | 5/1956 | Ferneau | 5/617 |
| 3,491,384 | 6/1970 | Hero | 5/191 |
| 3,636,574 | 6/1972 | Kramer | 5/191 |
| 3,838,469 | 10/1974 | Redemaker | 5/186.1 |
| 4,813,656 | 3/1989 | Ramsey . | |

FOREIGN PATENT DOCUMENTS

| | | | |
|---|---|---|---|
| 102483 | 11/1937 | Australia | 5/186.1 |
| 576388 | 1/1924 | France | 5/186.1 |

*Primary Examiner*—Renee S. Luebke
*Assistant Examiner*—F. Saether
*Attorney, Agent, or Firm*—Price, Heneveld, Cooper, DeWitt & Litton

[57] ABSTRACT

An adjustable bed including a multi-section mattress frame mounted on a base frame. The mattress frame includes a head section and a lower section. The lower section may include an intermediate or seat section and a leg section. A mattress support is joined to the mattress frame. The mattress support includes a plurality of wire grids joined to the sections. Each grid includes a plurality of tandemly arranged, transversely extending, generally rectangular closed loops. End portions of the loops are axially aligned and joined to lateral or side portions of the mattress frame. A plurality of parallel, longitudinally or axially extending support wires are positioned on the loops. The support wires extend generally parallel to the lateral portions or sides of the mattress frame. Ends of the support wires may be downturned and joined to an end wire.

22 Claims, 4 Drawing Sheets

ADJUSTABLE BED WITH WIRE GRID MATTRESS SUPPORT

BACKGROUND OF THE INVENTION

The present invention relates to beds and more particularly to mattress supports for adjustable, multi-section beds.

A conventional residential bed includes a frame, a box spring and a mattress. The mattress is positioned on the box spring. Many different types of adjustable beds have been proposed principally for use in the healthcare industry. A typical hospital or nursing home bed includes a base frame and a multi-section mattress frame. The mattress frame may include a head section and a lower section. The lower section may, in turn, be separated into a seat or intermediate section and a foot section. The sections are pivotally interconnected and their relative positions may be changed. The occupant may be moved from a horizontal position to a seated position with the knees bent, for example. The sections may be adjusted manually or electric motors may be provided. Generally, healthcare beds are only provided in a non-standard or reduced width twin bed size. The twin bed may be approximately four inches less than the standard residential twin bed to facilitate movement of the bed through doors and the like.

Healthcare beds have generally included a sheet metal pan or a wire grid work to support the mattress on the frame. The grid work includes longitudinally extending and transversely extending wires supported by a plurality of extension springs. Articulation of the bed sections results in relative movement between the mattress and the mattress support and frame structure.

Available healthcare beds have not been generally accepted in the residential or general consumer market due, in part, to cost and complexity. The advantages of adjustability have generally not, therefore, been available to the consumer. The narrower than standard width of the healthcare bed has also limited appeal. Any attempt to articulate a standard box spring construction would be cost prohibitive. The relative motion between the mattress and the support would result in undesirable friction and fabric wear. The standard wire grid supports used in the healthcare beds are structurally inadequate for double or full and queen size bed versions, which would find appeal in the residential market.

A need exists, therefore, for an adjustable bed including a mattress support surface which can provide an essentially friction and wear-free interface with the mattress, which can be adapted to twin, full and queen size articulating beds and which is relatively inexpensively manufactured and reliable in use.

SUMMARY OF THE INVENTION

In accordance with the present invention, the aforementioned needs are fulfilled. Essentially, a wire grid work mattress support is provided which includes a plurality of closed loop members arranged in tandem, generally parallel relationship. A plurality of mattress support wires are joined to the loop members. The loop members are joined to side portions of a mattress frame. The support wires extend in spaced, parallel relationship and generally parallel to the side portions of the mattress frame. The parallel support wires provide a relatively friction and wear-free interface with a mattress. In addition, the support wires limit or prevent sideways movement of the mattress on the frame. The mattress still, however, easily moves as the bed is adjusted. The closed loop members provide sufficient structural strength to adapt the mattress support to conventional bed widths.

In narrower aspects of the invention, the wire loop members are generally rectangular in plan, having end portions which are axially aligned. The end portions are welded or otherwise suitably joined to the mattress frame. An end of the grid work has the support wires downturned and joined to an end wire. The end wire may be U-shaped with legs joined to a transverse end wire. The downturning of the ends prevents snagging with the mattress and increases the strength or rigidity of the grid work.

In addition, increased structural support may be provided by a plurality of longitudinally extending space wires joined to the wire loop members and extending generally parallel to the support wires. Another set of transversely extending closed loop members may be secured to the support wires. In the preferred form, this set of closed loop members is positioned in staggered relationship to the set positioned under the support wires. The additional spacer wires and rectangular loop members provide increased strength to accommodate standard or double and queen size mattress widths.

The mattress support in accordance with the present invention is relatively easily manufactured from standard steel wire currently used in healthcare bed products. The support surface provides a relatively friction and wear-free interface between the support and mattress. The support is readily adapted to twin, full and queen size articulating beds. The mattress support permits the advantages of articulating bed structures to be provided to the consumer, residential or general retail market.

DETAILED DESCRIPTION OF THE PREFERRED EMBODIMENT

Figure 1:
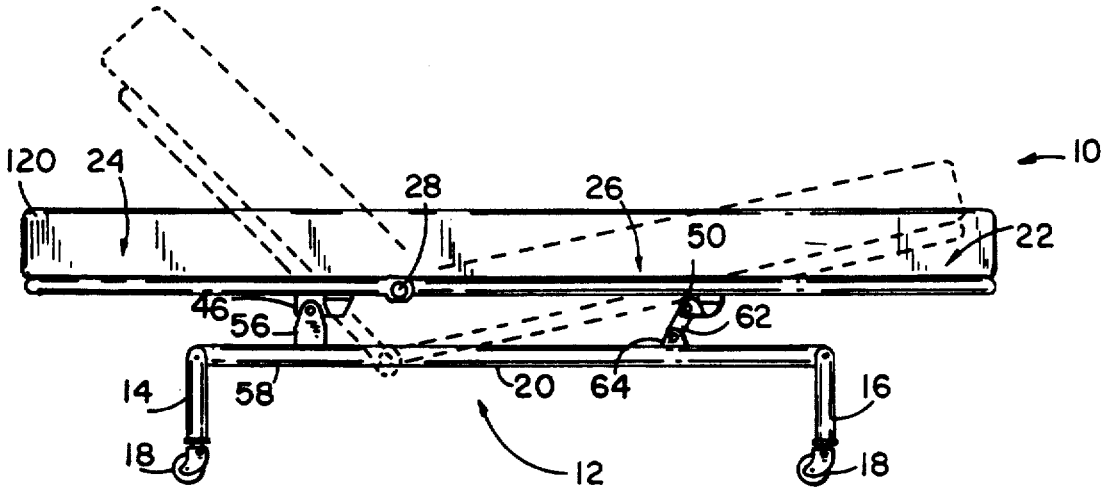
FIG. 1 is a side, elevational view of an adjustable bed with an articulated or adjusted position shown in phantom.

An adjustable bed incorporating the mattress support in accordance with the present invention is illustrated in FIG. 1 and generally designated by the numeral 10. Bed 10 includes a castored base frame 12 having legs 14, 16 supported on castors 18. Base frame 12 defines lateral side portions 20. A multi-section mattress frame 22 is positioned on base frame 12.

Mattress frame 22 includes a head section 24 and a lower section 26. For simplicity, only a two section adjustable bed is illustrated. Commonly owned U.S. Pat. application to Peterson, Ser. No. 07/540,282, filed Jun. 18, 1990, entitled ADJUSTABLE BED and now U.S. Pat. No. 5,105,486 discloses a bed wherein the lower section 26 includes an intermediate or seat section pivoted to a foot section. The three section bed permits adjustment into a "knee break" position.

Figure 2:
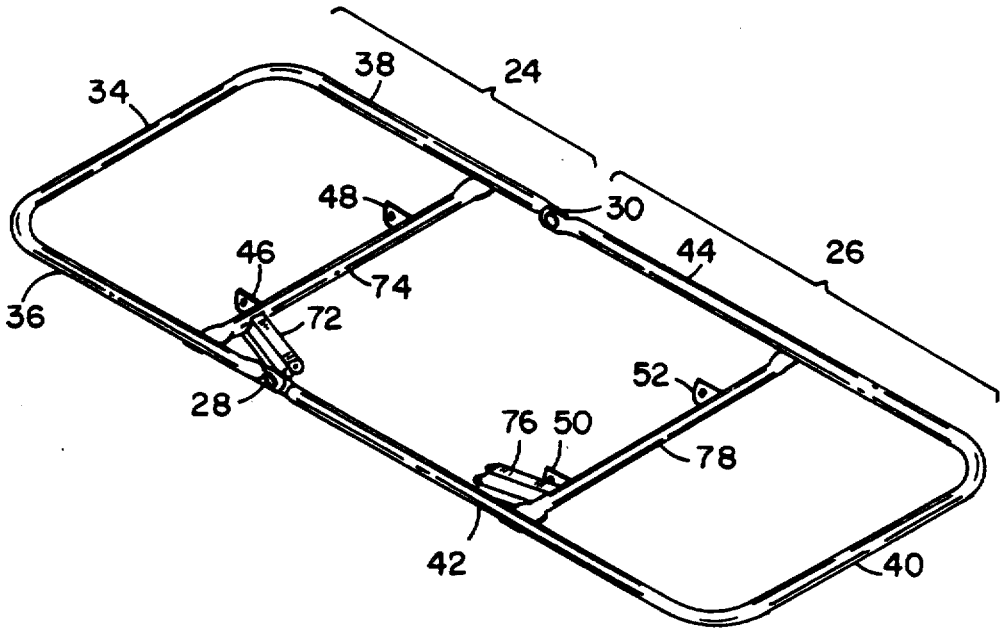
FIG. 2 is a perspective view of a mattress frame incorporated in the present invention.

Section 26 is pivotally interconnected to section 24 at pivot ends 28, 30. As shown in FIGS. 1 and 2, sections 24, 26 are formed by tubular members. Section 24 is generally U-shaped in plan and includes a base 34 and elongated lateral portions 36, 38. Lower section 26 includes a base 40 and elongated lateral portions 42, 44. Sections 24, 26 are formed by bending circular in cross section tubular members and deforming the end portions to define pivot ends 28, 30. The tubular sections eliminate or reduce sharp corners or edges which could possibly cut or injure the user if portions of the occupant are caught between the bed frame and stationary objects during adjustment.

As shown in FIGS. 1 and 2, mattress support frame 22 includes mounting tabs 46, 48, 50 and 52. Tabs 46, 48 are pivoted to rigid links 56 which extend from side portions 58 of base frame 12. Links 62 extend between attachment tabs 50, 52, and link brackets 64 join to portions 58 of frame 12. Link 62 permits longitudinal movement of the bed frame as it is moved from a flat horizontal position illustrated in solid lines in FIG. 1 to a contoured or seated position, as illustrated in phantom.

Figure 3:
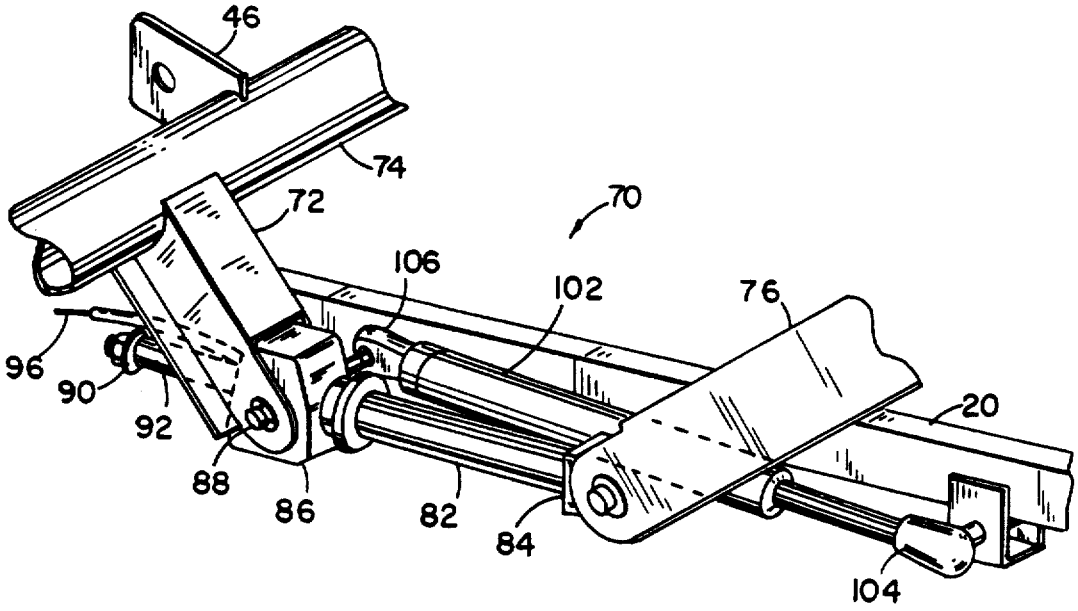
FIG. 3 is a fragmentary, enlarged perspective view of the mattress frame, a bed frame or base and a positioner.

Various mechanisms may be used to hold the mattress frame sections in angular positions. FIG. 3 illustrates a linear positioner, generally designated 70, which may be used. As shown in FIGS. 2 and 3, a rigid link 72 is joined to a transversely extending tubular portion 74 of frame section 24. A second rigid link 76 is joined to a transversely extending tubular portion 78 of frame portion 26. An elongated rod 82 is pivoted at an end 84 to rigid link 76. Rod 82 extends through a linear positioner lock mechanism 86. Mechanism 86 is pivoted by a point 88 to rigid link 72. An adjustable stop 90 is positioned on end 92 of linear positioner rod 82. Positioned within lock mechanism 86 are a pair of spaced, apertured lock plates (not shown) through which rod 82 extends. The lock may be released from contact with rod 82 by a cam mechanism actuated by a cable 96. The linear positioner and lock mechanism are more fully described and illustrated in the aforementioned U.S. Pat. application Ser. No. 07/540,282. A gas spring 102 extends between link 72 at pivot pin 88. Gas spring 102 is pivoted at an end 104 to base frame portion 20. An opposite end 106 is pivoted to strut 72. The sections 24, 26 may be manually moved to an angular position or placed in the horizontal position and locked in position through the linear positioner 70. Other lock mechanisms may, of course, be used in an adjustable bed.

Figure 4:
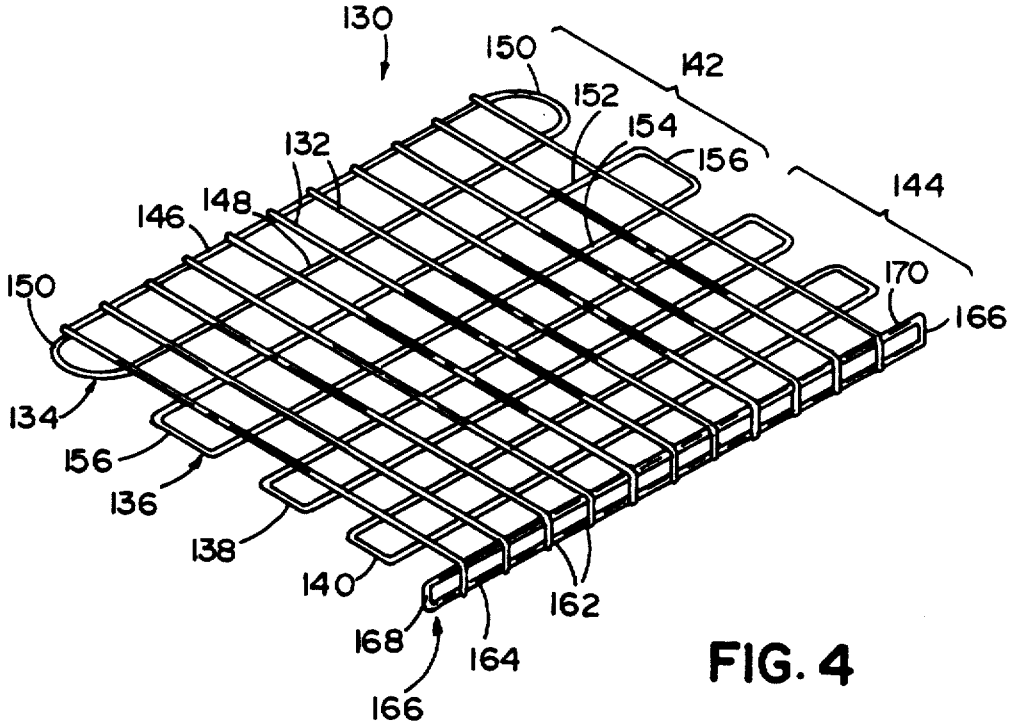
FIG. 4 is a perspective view of a mattress support in accordance with the present invention.

A mattress 120 is placed on mattress frame 22. A wire grid work, generally designated 130 in FIG. 4, provides a mattress support structure. The grid work includes a plurality of longitudinally extending, parallel, equally spaced support wires 132. A plurality of closed loop wire members 134, 136, 138 and 140 are joined to an under surface of support wires 132. Grid work 130 defines two areas designated 142 and 144. Grid work 130 is joined to upper frame section 24, as explained below, and area 144 is adjacent the seat or lower back area of the bed.

When in position, closed loop member 134 is adjacent the head end of the bed. Member 134 includes spaced, parallel transversely extending portions 146, 148. Portions 146, 148 are joined to semicircular end portions 150. Curved portions 150 approximate the curvature of the corners or bent portions where the base 34 and legs 36, 38 of frame section 24 join.

Each of the transversely extending wire loop members 136, 138 and 140 includes spaced, parallel transversely extending portions 152, 154 joined to end portions 156. End portions 156 of the tandemly arranged, spaced loop members are in axial alignment. Loop members 136, 138 and 140 are generally rectangular in plan view. The axial dimension of end portions 156 in loops 138, 140 is less than the axial dimension of end portion 156 of loop 136. The configuration of the loops within the seat area 144 increases the density of transverse wire portions. This increases the strength, rigidity and load carrying capacity of the grid work at the seat area.

End portions 162 of wires 132 are downturned at a 90° angle with respect to the longitudinally extending portions of the wire. In the embodiment shown in FIG. 4, these downturned ends are joined to a base 164 of a generally U-shaped end wire 166. Upstanding legs 168 of end wire 166 are joined to a transversely extending end wire 170. End wire 166 in conjunction with the downturned ends 162 forms a truss-like structure at the end of the grid work 130 which increases the strength and rigidity. Downturning of the ends also ensures that the grid work will not snag or catch on the mattress which moves along support wires 132 during bed adjustment.

Figure 6:
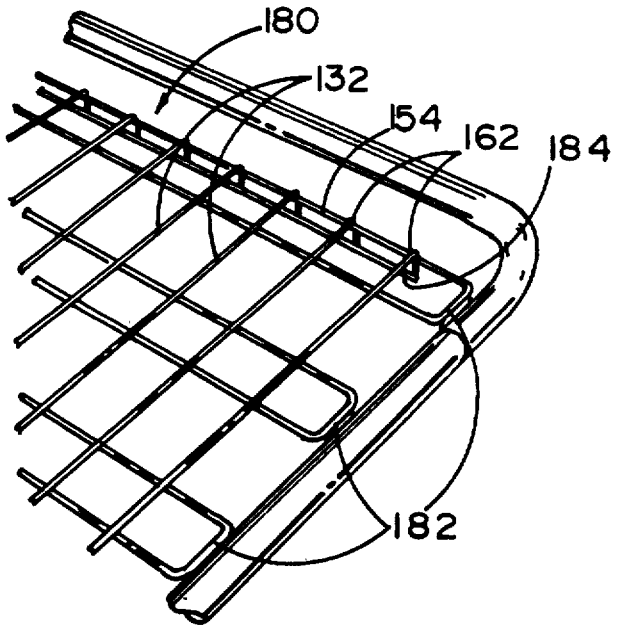
FIG. 6 is a fragmentary, perspective view showing a modified mattress support attached to a bed frame.

As shown in FIG. 6, another grid work 180 is provided for lower section 26 of the mattress frame. Grid work 180, which is of the same general construction as grid work 130, includes a plurality of longitudinally extending wires 132 which are joined and supported on generally rectangular closed loop wire members 182. As an alternative to end wire 166, wires 132 at their downturned ends 162 may be joined to a transverse, end wire 184. Transverse wire portion 154 of the lower most closed loop member 182 performs the function as the transverse wire 170 illustrated in FIG. 4. The end of grid work 180 adjacent the pivot between the frame sections is also downturned in the same fashion as illustrated in either FIG. 4 or 6. If a three section mattress frame is provided, the intermediate section is provided with an identical grid work with both ends downturned, as illustrated.

Figure 5:
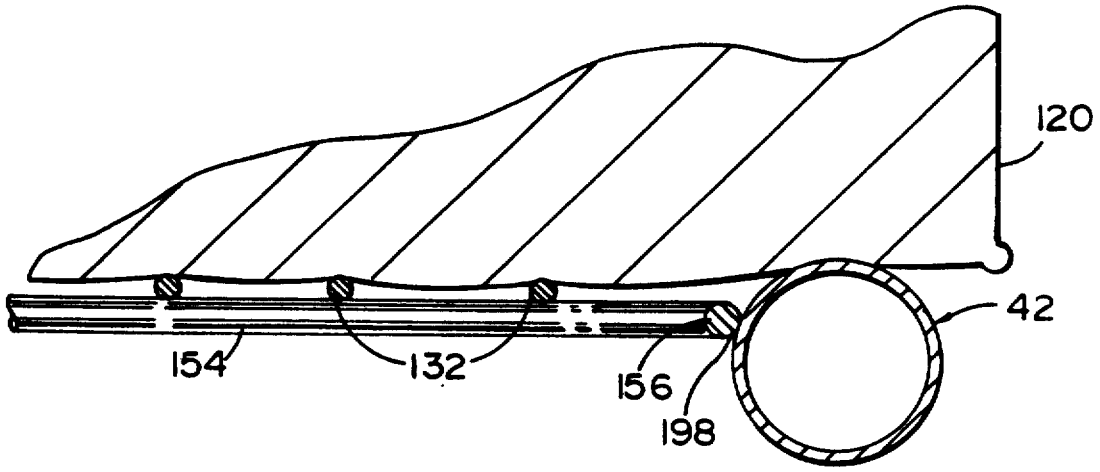
FIG. 5 is a fragmentary, cross-sectional view showing the attachment of the mattress support to the mattress frame.

Grid works 130, 180 are joined to mattress frame sections 24, 26 as illustrated in FIGS. 5 and 6. The straight or linearly extending end portions 156 of the loops are joined by a weld 198 to lateral tubular portions 36, 38 or 42, 44 of the respective mattress frames. As shown, mattress 120 sits on the longitudinally extending support wires 132. The support wires, due to their positioning and sizing, provide a relatively friction-free interface between mattress 120 and the mattress support grid work. In addition, mattress 120 will deform into the space between adjacent wires 132. The grid work limits or prevents sideways movement between the lateral portions of the mattress frame.

Figure 7:
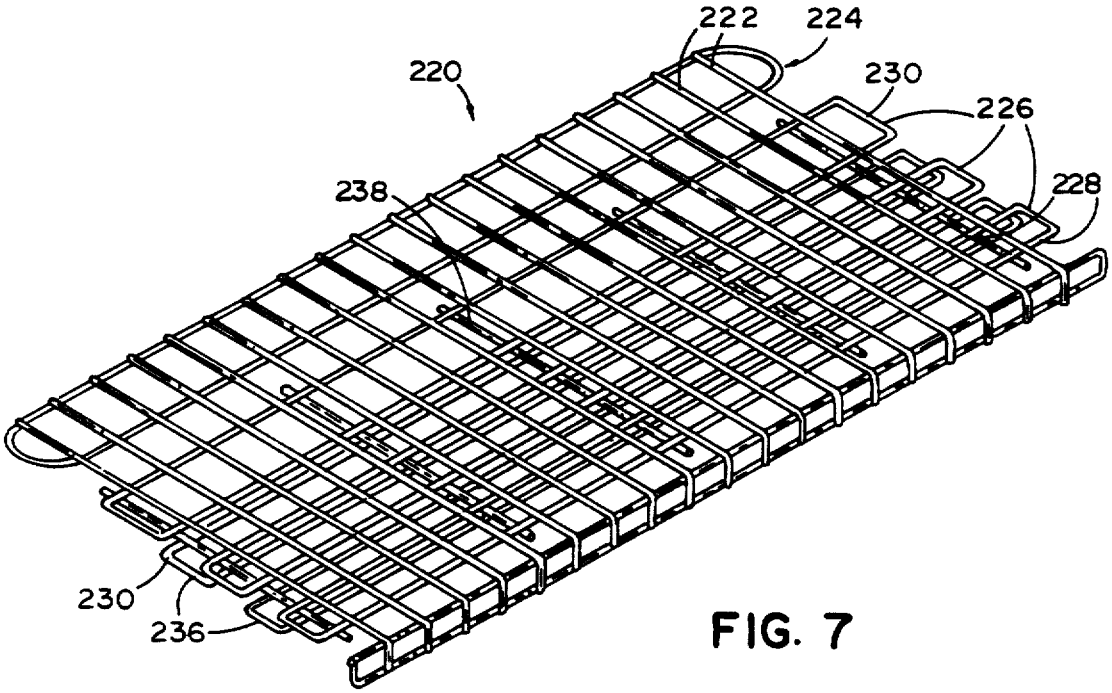
FIG. 7 is a perspective view of another mattress support in accordance with the present invention.
Figure 8:
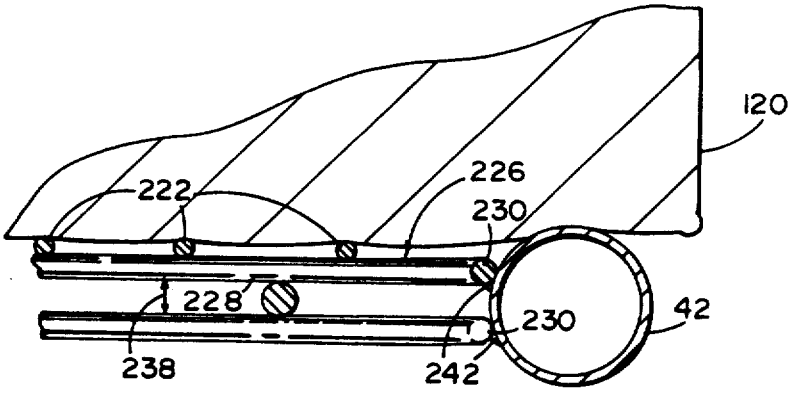
FIG. 8 is a fragmentary, cross-sectional view showing the attachment of the embodiment of FIG. 7 to a mattress frame.

The mattress support grid work of FIGS. 4, 5 and 6 is primarily adapted for a conventional twin bed width. For larger or wider full, double or queen size mattress frames, a grid work generally designated 220 and illustrated in FIGS. 7 and 8, is presently preferred. Grid work 220 includes a plurality of longitudinally extending mattress support wires 222. Mattress support wires 222 are positioned on a first layer of transversely extending closed loop members 224 and 226. Members 226 adjacent the seating area of the grid work provide an increased density of transverse wire portions 228. The closed loop, generally rectangular members 226 include axially aligned end portions 230.

Increased strength is provided in embodiment 220 by another layer of rectangular closed loop members 236. A plurality of spacer wires 238 are joined to closed loop members 226. Spacer wires 238 extend parallel to and are staggered between wires 222. Members 236 are joined to wires 238. Wires 238 space loop members 236 from loop members 226. As shown in FIG. 7, members 236 are joined to spacer wires 238 in a staggered position, in plan view, with respect to loop members 226. Loop members 236 similarly include axially aligned end portions 230.

As shown in FIG. 8, end portions 230 of loop members 226, 236 are joined to the lateral portions of the mattress support frame by suitable welds 242. The staggering of the rectangular loop members permit access to and alternate welding of both layers of the loop members to the longitudinally extending wires. Grid work 220 creates a truss-like arrangement of wire structure. The truss-like arrangement reliably supports the heaviest expected bed occupants over the entire width of full and queen size beds. End portions of grid work 220 are downturned in the same fashion of the embodiment of FIGS. 4 and/or 6 to prevent snagging or tearing of the mattress.

The grid works of the present invention provide sufficient strength to support a mattress and the occupants in an adjustable bed. The grid works are easily and relatively inexpensively manufactured using wire and conventional techniques. Increased strength and rigidity is provided at the seat areas of the bed by increasing the density of the transverse wire portions of the loop members. A relatively friction and wear-free interface is created between the mattress and the mattress support. Sideways movement of the mattress on the support is restricted or prevented.

In view of the above description, those of ordinary skill in the art may envision various modifications which would not depart from the inventive concepts disclosed herein. The above description should, therefore, be considered as only that of the preferred embodiments. The true spirit and scope of the present invention may be determined by reference to the appended claims.

The embodiments of the invention in which an exclusive property or privilege is claimed are defined as follows:

1. A mattress frame for an adjustable bed, said frame comprising:

a generally U-shaped member including an end section joined to spaced, generally parallel side sections; and a rigid wire grid work affixed to said U-shaped member, said grid work including:

a plurality of transversely extending, spaced closed wire loops, said loops each having ends joined to said side sections; and a plurality of longitudinally extending, spaced, parallel support wires, said support wires being joined to and resting on said spaced closed wire loops and positioned to contact a mattress placed on said U-shaped member.

2. A mattress frame as defined by claim 1 wherein said longitudinally extending support wires have downwardly turned ends.

3. A mattress frame as defined by claim 2 further including an end wire joined to said downwardly turned ends.

4. A mattress frame as defined by claim 3 wherein said end wire includes a base and upstanding legs, said downturned ends being joined to said base and wherein said frame further includes a transverse end wire joined to said support wires and to said upstanding legs of said end wire.

5. A mattress frame as defined by claim 4 wherein said wire loops are each generally rectangular in plan view with parallel end portions, said end portions of adjacent loops being axially aligned.

6. A mattress frame as defined by claim 5 further including an end wire loop having transversely extending, spaced parallel wire portions joined to curved end portions.

7. A mattress frame as defined by claim 1 wherein said wire loops are each generally rectangular in plan view with parallel end portions, said end portions of adjacent loops being axially aligned.

8. A mattress frame as defined by claim 7 further including an end wire loop having transversely extending, spaced parallel wire portions joined to curved end portions.

9. A mattress frame as defined by claim 1 wherein said grid work further includes a plurality of longitudinally extending spacer wires joined to said closed wire loops.

10. A mattress frame as defined by claim 9 wherein said grid work further includes a plurality of lower, transversely extending, spaced closed wire loops, said lower closed wire loops engaging said spacer wires and having end portions joined to said side sections.

11. A mattress frame as defined by claim 10 wherein said lower closed wire loops are staggered with respect to said plurality of spaced closed wire loops so as to be positioned between said plurality of closed wire loops when the grid work is viewed in plan.

12. A mattress frame as defined by claim 11 wherein said lower closed wire loops are generally rectangular in plan and said end portions thereof are axially aligned.

13. A mattress frame as defined by claim 12 wherein said longitudinally extending support wires have downwardly turned ends.

14. A mattress frame as defined by claim 13 further including a generally U-shaped end wire having a base joined to said downwardly turned ends and upstanding legs.

15. A mattress frame as defined by claim 14 further including a transverse end wire joined to said top surface wire and to said upstanding legs of said end wire.

16. An adjustable bed, comprising:

a base frame;

a mattress frame including ahead section and a lower section operatively connected to said head section for relative angular movement, said sections each including spaced, generally parallel lateral portions;

mounting means on the base frame and connected to said mattress frame for mounting the mattress frame to the base frame and permitting the head section to be positioned and locked in different angular positions with respect to the base frame and said lower section;

a head section mattress support wire grid on said mattress frame head section; and a lower section mattress support grid on said mattress frame lower section, each of said grids including:

a plurality of generally rectangular, closed loop members arranged in tandem, spaced, generally parallel relationship, said loop members each including end portions joined to said lateral portions of the respective mattress frame sections; and a plurality of spaced, parallel support wires positioned on said loops and extending generally parallel to said lateral portions.

17. An adjustable bed as defined by claim 16 wherein support wires of said head section grid include lower ends which are bent downwardly and said lower section grid includes upper and lower ends which are bent downwardly.

18. An adjustable bed as defined by claim 17 wherein said head section grid further includes an end wire joined to said downturned ends.

19. An adjustable bed as defined by claim 18 wherein said head section grid further includes a transverse end wire joined to said support wire and to said end wire.

20. An adjustable bed as defined by claim 19 wherein each of said grids includes a plurality of longitudinally extending spacer wires joined to said closed loops and extending generally parallel to said support wires.

21. An adjustable bed as defined by claim 20 wherein each of said grids further includes a plurality of lower closed loops having transverse portions engaging said spacer wires and end portions joined to said lateral portions of one of the mattress frame sections.

22. An adjustable bed as defined by claim 21 wherein said lower closed loops in plan are positioned between said plurality of generally rectangular closed loops.

* * * * *

UNITED STATES PATENT AND TRADEMARK OFFICE

CERTIFICATE OF CORRECTION

PATENT NO. : 5,155,881

DATED : October 20, 1992

INVENTOR(S) : G. Scott Lafferty

It is certified that error appears in the above-identified patent and that said Letters Patent is hereby corrected as shown below:

Column 6, line 61;

"ahead" should be --a head--.

Title page, item [73] Assignee:

"Batts, Inc., Zeeland, Mich." should be

--Joerns Healthcare Inc., Stevens Point, Wis.--.

Signed and Sealed this

First Day of March, 199

Attest:

Bruce Lehman

BRUCE LEHMAN

Attesting Officer

Commissioner of Patents and Trademarks